US005591056A

United States Patent [19]

Patino

[11] Patent Number: 5,591,056

[45] Date of Patent: Jan. 7, 1997

[54] MOTORCYCLE PROPELLED BOAT

[76] Inventor: Francisco Patino, 42-25 Hampton St. Apt. 706, Elmhurst, N.Y. 11373

[21] Appl. No.: 562,054

[22] Filed: Nov. 22, 1995

[51] Int. Cl.[6] ..... B63H 21/175

[52] U.S. Cl. ..... 440/12

[58] Field of Search ..... 440/11, 12

[56] References Cited

U.S. PATENT DOCUMENTS

| | | | |
|---|---|---|---|
| 547,422 | 10/1895 | Dean | 440/12 |
| 3,826,216 | 7/1974 | Rhody | 440/12 |
| 3,965,843 | 6/1976 | Smith | 440/12 |
| 4,636,176 | 1/1987 | Capilla | 440/12 |

FOREIGN PATENT DOCUMENTS

| | | | |
|---|---|---|---|
| 514927 | 2/1955 | Italy | 440/12 |

*Primary Examiner*—Jesus D. Sotelo

[57] ABSTRACT

A motorcycle propelled boat comprised of a boat portion. A front portion is dimensioned to receive a front wheel of a motorcycle therein. The front portion is rotatably secured to the boat deck. A rear portion is dimensioned to receive a rear wheel of a motorcycle therebetween. The rear portion has a drive belt disposed therein positionable underneath a rear wheel of a motorcycle. A propulsion portion is drivingly connected to the drive belt of the rear portion. A rudder is rotatably coupled with a rear portion of the boat portion. A steering mechanism is comprised of a pair of elongated flexible cables secured to the front portion and secured to the rudder.

1 Claim, 3 Drawing Sheets

MOTORCYCLE PROPELLED BOAT

BACKGROUND OF THE INVENTION

1. Field of the Invention

The present invention relates to a motorcycle propelled boat and more particularly pertains to providing a multipurpose vehicle for transportation of people with a motorcycle propelled boat.

2. Description of the Prior Art

The use of boats and attachments for motorcycles is known in the prior art. More specifically, boats and attachments for motorcycles heretofore devised and utilized for the purpose of propelling a boat are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,050,399 to Mochel discloses an attachment for motorcycles. U.S. Pat. No. 4,522,601 to Yoo discloses a boat arranged to carry temporarily a vehicle. U.S. Pat. No. 4,936,801 to Herrit discloses a bicycle watercraft assembly. U.S. Pat. No. Des. 324,509 to Valenti discloses the ornamental design for a boat for use with a motorcycle. U.S. Pat. No. 3,854,436 to Cox discloses a motorcycle boat. U.S. Pat. No. 4,636,176 to Capilla discloses a boat propelled by a motorcycle. While these devices fulfill their respective, particular objective and requirements, the aforementioned patents do not describe a motorcycle propelled boat for providing a multipurpose vehicle for transportation of people.

In this respect, the motorcycle propelled boat according to the present invention substantially departs from the conventional concepts and designs of the prior art, and in doing so provides an apparatus primarily developed for the purpose of providing a multipurpose vehicle for transportation of people.

Therefore, it can be appreciated that there exists a continuing need for new and improved motorcycle propelled boat which can be used for providing a multipurpose vehicle for transportation of people. In this regard, the present invention substantially fulfills this need.

SUMMARY OF THE INVENTION

In the view of the foregoing disadvantages inherent in the known types of boats and attachments for motorcycles now present in the prior art, the present invention provides an improved motorcycle propelled boat. As such, the general purpose of the present invention, which will be described subsequently in greater detail, is to provide a new and improved motorcycle propelled boat and method which has all the advantages of the prior art and none of the disadvantages.

To attain this, the present invention essentially comprises a boat portion comprised of a pair of elongated inflatable pontoons secured on opposing end. portions of a boat deck. The boat deck has a front portion and a rear portion. The device includes a front portion comprised of an upper ramp portion dimensioned to receive a front wheel of a motorcycle therein. The front portion has a rotating portion. The rotating portion has a lower portion secured to the boat deck inwardly of the front portion thereof. The upper ramp portion has a shoulder bolt secured to the lower portion. The rotating portion has an upper portion secured to the upper ramp portion disposed over the lower portion. The rotating portion has ball bearings between the upper portion and the lower portion. The device includes a rear portion comprised of a pair of elongated rods extending upwardly from the boat deck inwardly of the rear portion thereof. The pair of elongated rods are dimensioned to receive a rear wheel of a motorcycle therebetween. Each of the rods has an adjustable clamp extending therethrough for coupling with an axle of the rear wheel. Each of the rods has a support rod securable to a carriage of a motorcycle. The rear portion has a drive belt disposed between the pair of elongated rods positionable underneath a rear wheel of a motorcycle. The device includes a propulsion portion comprised of a propeller secured to the rear portion of the boat deck. The propulsion portion has a gear box drivingly connected to the drive belt of the rear portion. The gear box has a drive cable extending therefrom to couple with the propeller. A rudder is rotatably coupled with the rear portion of the boat deck. The rudder has a pair of securement portions extending orthogonally therefrom. The device includes a steering mechanism comprised of pair of elongated flexible cables. Each of the cables has a first end and a second end. Each first end is secured to the upper portion of the rotating portion of the front portion. Each second end is secured to the pair of securement portions of the rudder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved motorcycle propelled boat which has all the advantages of the prior art boats and attachments for motorcycles and none of the disadvantages.

It is another object of the present invention to provide a new and improved motorcycle propelled boat which may be easily and efficiently manufactured and marketed.

It is a further object of the present invention to provide a new and improved motorcycle propelled boat which is of durable and reliable construction.

An even further object of the present invention is to provide a new and improved motorcycle propelled boat which is susceptible of a low cost of manufacture with regard to both materials and labor, and which accordingly is then susceptible of low prices of sale to the consuming public, thereby making such a motorcycle propelled boat economically available to the buying public.

Still yet another object of the present invention is to provide a new and improved motorcycle propelled boat which provides in the apparatuses and methods of the prior art some of the advantages thereof, while simultaneously overcoming some of the disadvantages normally associated therewith.

Even still another object of the present invention is to provide a new and improved motorcycle propelled boat for providing a multipurpose vehicle for transportation of people.

Lastly, it is an object of the present invention to provide a new and improved motorcycle propelled boat comprised of a boat portion. A front portion is dimensioned to receive a front wheel of a motorcycle therein. The front portion is rotatably secured to the boat deck. A rear portion is dimensioned to receive a rear wheel of a motorcycle therebetween. The rear portion has a drive belt disposed therein positionable underneath a rear wheel of a motorcycle. A propulsion portion is drivingly connected to the drive belt of the rear portion. A rudder is rotatably coupled with a rear portion of the boat portion. A steering mechanism is comprised of a pair of elongated flexible cables secured to the front portion and secured to the rudder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
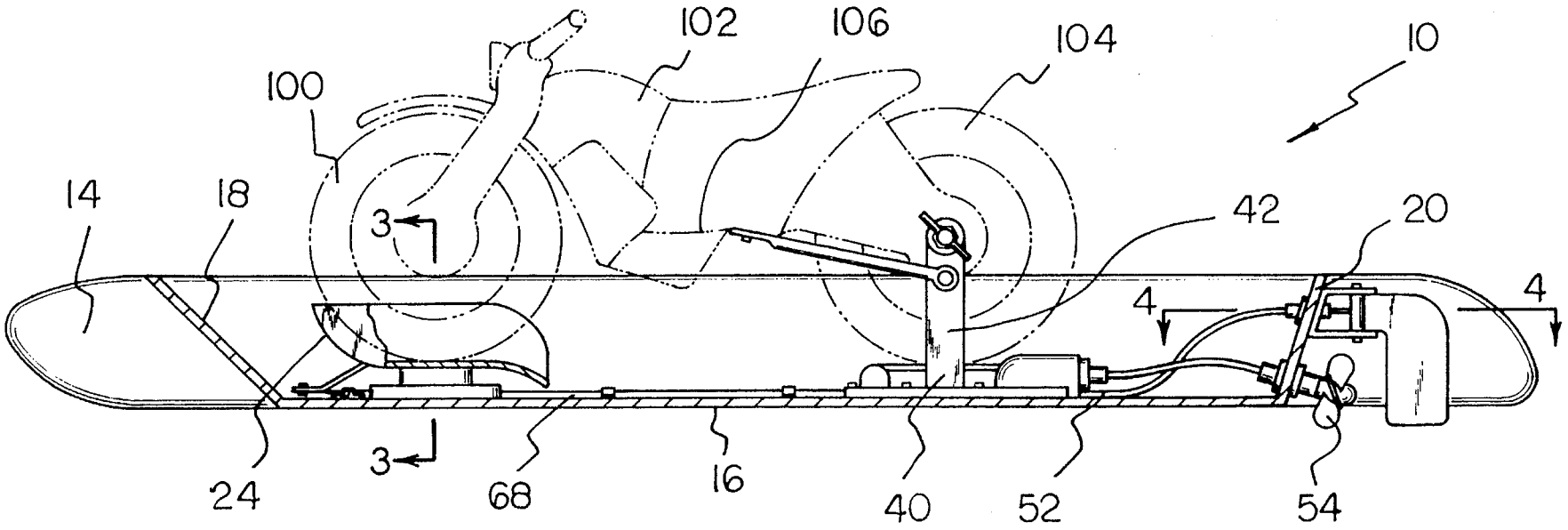
FIG. 1 is a side view of the preferred embodiment of the motorcycle propelled boat constructed in accordance with the principles of the present invention.
Figure 2:
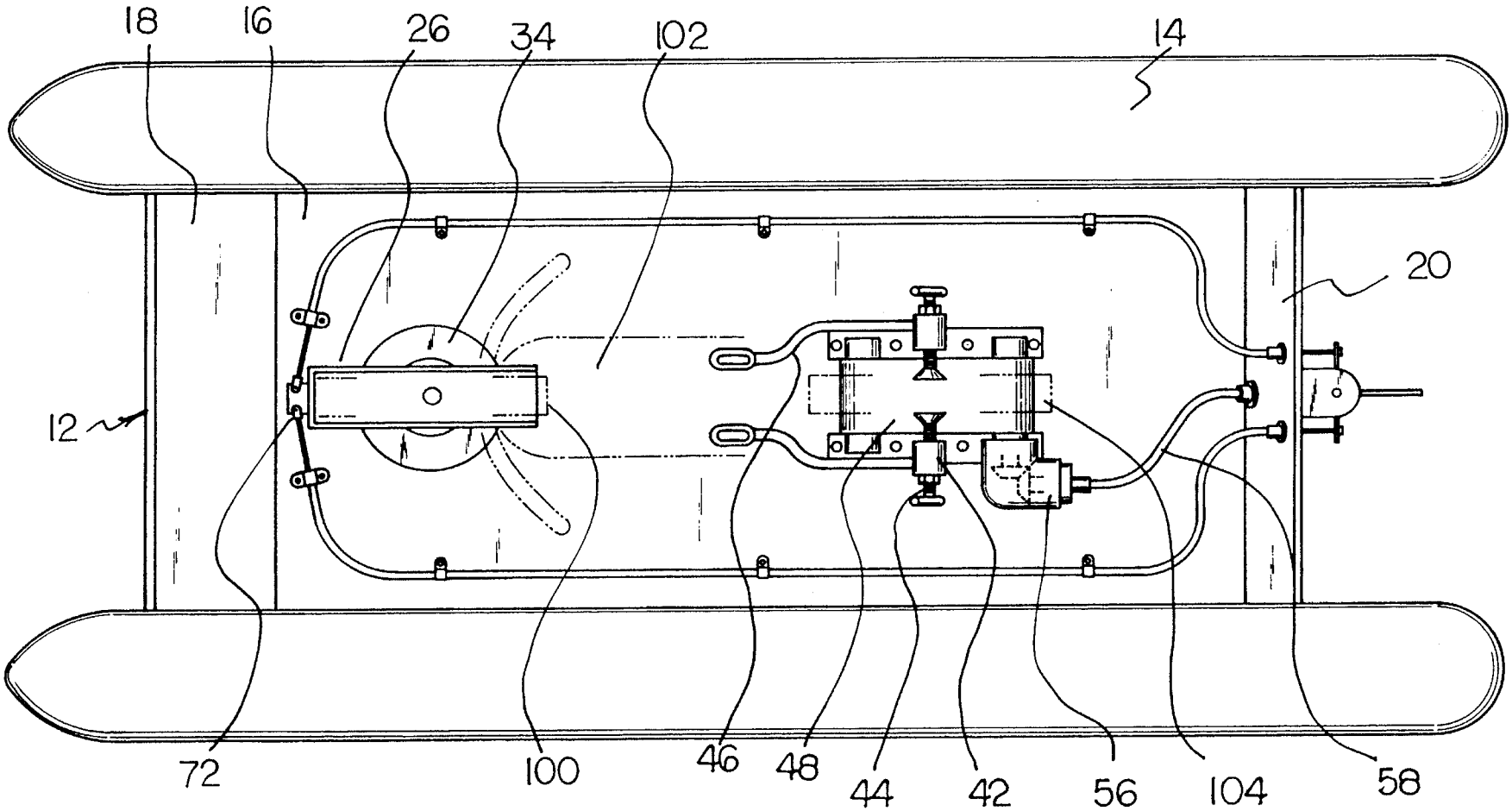
FIG. 2 is a plan view of the preferred embodiment of the present invention.
Figure 3:
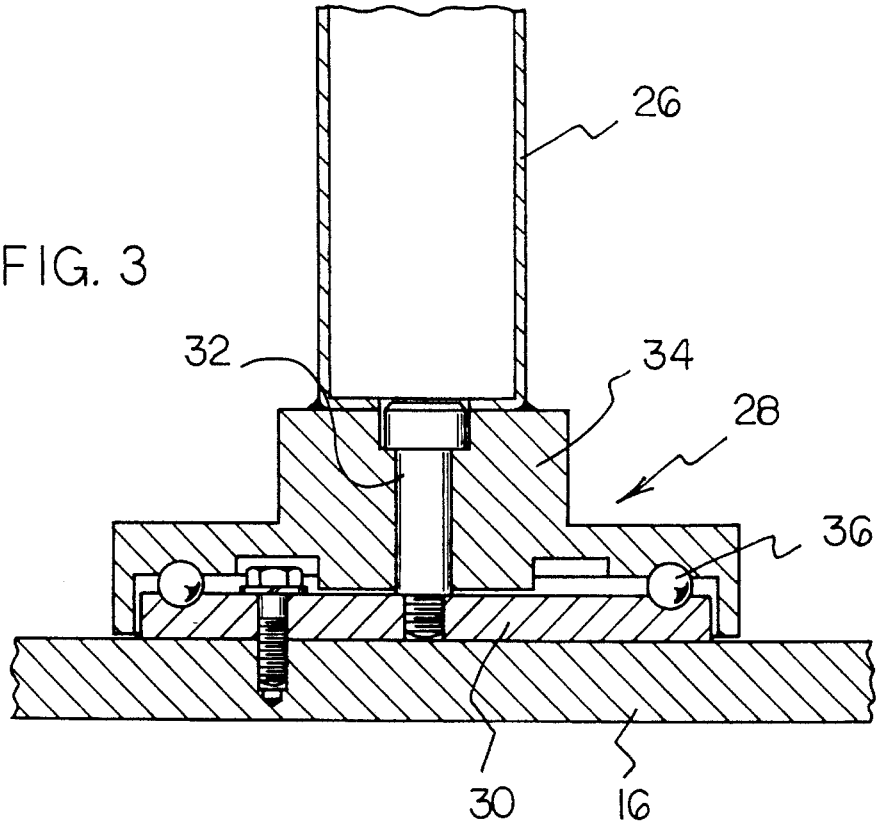
FIG. 3 is a cross-sectional view of the front portion of the present invention taken in cross-section along line 3—3 of FIG. 1.
Figure 4:
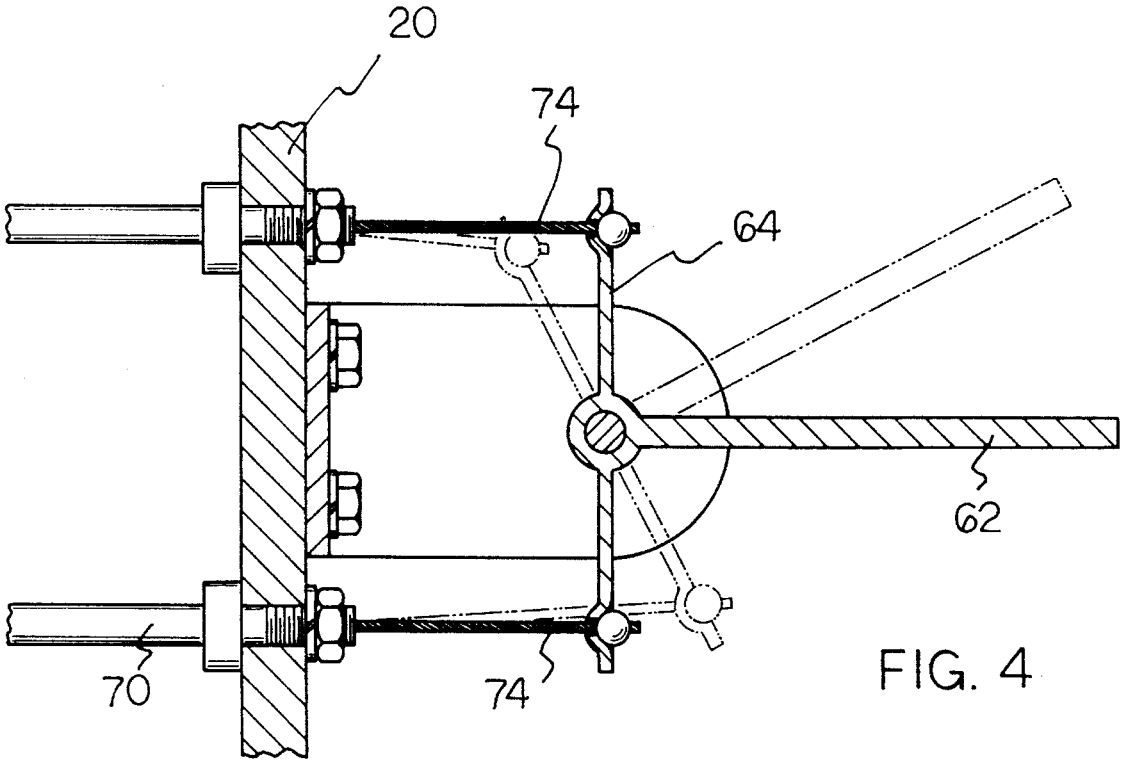
FIG. 4 is a cross-sectional view of the rear portion of the present invention taken in cross-section along line 4—4 of FIG. 1.

With reference now to the drawings, and in particular, to Figure's 1–4 thereof, the preferred embodiment of the new and improved motorcycle propelled boat embodying the principles and concepts of the present invention and generally designated by the reference number 10 will be described.

Specifically, it will be noted in the various Figures that the device relates to a new and improved motorcycle propelled boat for providing a multipurpose vehicle for transportation of people. In its broadest context, the device consists of a boat portion, a front portion, a rear portion, a propulsion portion, a rudder, and a steering mechanism. Such components are individually configured and correlated with respect to each other so as to attain the desired objective.

The device 10 includes a boat portion 12 comprised of a pair of elongated inflatable pontoons 14 secured on opposing end portions of a boat deck 16. The boat deck 16 has a front portion 18 and a rear portion 20. The front portion 18 extends outwardly at an incline from the boat deck 16. The pontoons 14 can be easily deflated to allow for ease of transportation of the device 10.

Next, the device 10 includes a front portion 24 comprised of an upper ramp portion 26 dimensioned to receive a front wheel 100 of a motorcycle 102 therein. The front portion 24 has a rotating portion 28. The rotating portion 28 has a lower portion 30 secured to the boat deck 16 inwardly of the front portion 18 thereof. The upper ramp portion 26 has a shoulder bolt 32 secured to the lower portion 30. The rotating portion 28 has an upper portion 34 secured to the upper ramp portion 26 disposed over the lower portion 30. The rotating portion 28 has ball bearings 36 between the upper portion 34 and the lower portion 30. Once the front wheel 100 of the motorcycle 102 is positioned within the upper ramp portion 26, a person driving the motorcycle 102 can steer the motorcycle 102 thereby steering the front portion 24 with the upper portion 34 rotating as the front wheel 100 is rotated.

The device 10 also includes a rear portion 40 comprised of a pair of elongated rods 42 extending upwardly from the boat deck 16 inwardly of the rear portion 20 thereof. The pair of elongated rods 42 are dimensioned to receive a rear wheel 104 of a motorcycle 102 therebetween. Each of the rods 42 has an adjustable clamp 44 extending therethrough for coupling with an axle of the rear wheel 104. The adjustable clamps 44 secure the motorcycle 102 in place and preclude the forward motion of the motorcycle 102. Each of the rods 42 has a support rod 46 securable to a carriage 106 of a motorcycle 102. The rear portion 40 has a drive belt 48 disposed between the pair of elongated rods 42 positionable underneath a rear wheel 104 of a motorcycle 102. Rotation of the rear wheel 104 or drive wheel of the motorcycle 102 will cause the rotation of the drive belt 48.

The device 10 further includes a propulsion portion 52 comprised of a propeller 54 secured to the rear portion 20 of the boat deck 16. The propulsion portion 52 has a gear box 56 drivingly connected to the drive belt 48 of the rear portion 40. The gear box 56 has a drive cable 58 extending therefrom to couple with the propeller 54. The gear box 56 provides for forward or reverse movement of the propeller 54 in relation to the rotation of the rear wheel 104 of the motorcycle for movement of the device 10.

Next, a rudder 62 is rotatably coupled with the rear portion 20 of the boat deck 16. The rudder 62 has a pair of securement portions 64 extending orthogonally therefrom. The rudder 62 is implemented to direct the directional movement of the device 10.

Lastly, the device 10 includes a steering mechanism 68 comprised of a pair of elongated flexible cables 70. Each of the cables 70 has a first end 72 and a second end 74. Each first end 72 is secured to the upper portion 34 of the rotating portion 28 of the front portion 24. Each second end 74 is secured to the pair of securement portions 64 of the rudder 62. Once the motorcycle 102 is steered, the movement of the front portion 24 will cause the rudder 62 to be directed in the same direction thereby providing for directional steering of the device 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A motorcycle propelled boat for providing a multipurpose vehicle for transportation of people comprising, in combination:

a boat portion comprised of a pair of elongated inflatable pontoons secured on opposing end portions of a boat deck, the boat deck having a front portion and a rear portion;

a front portion comprised of an upper ramp portion dimensioned to receive a front wheel of a motorcycle therein, the front portion having a rotating portion, the rotating portion having a lower portion secured to the boat deck inwardly of the front portion thereof, the upper ramp portion having a shoulder bolt secured to the lower portion, the rotating portion having an upper portion secured to the upper ramp portion disposed over the lower portion, the rotating portion having ball bearings between the upper portion and the lower portion;

a rear portion comprised of a pair of elongated rods extending upwardly from the boat deck inwardly of the rear portion thereof, the pair of elongated rods dimensioned to receive a rear wheel of a motorcycle therebetween, each of the rods having an adjustable clamp extending therethrough for coupling with an axle of the rear wheel, each of the rods having a support rod securable to a carriage of a motorcycle, the rear portion having a drive belt disposed between the pair of elongated rods positionable underneath a rear wheel of a motorcycle, the drive belt having a pair of rolling rods positioned within opposing ends thereof, the rear wheel of the motorcycle positionable on the drive belt whereby rotation of the rear wheel rotates the drive belt and the pair of rolling rods;

a propulsion portion comprised of a propeller secured to the rear portion of the boat deck, the propulsion portion having a gear box drivingly connected to the one of the rolling rods of the drive belt of the rear portion, the gear box having a drive cable extending therefrom to couple with the propeller;

a rudder rotatably coupled with the rear portion of the boat deck, the rudder having a pair of securement portions extending orthogonally therefrom;

a steering mechanism comprised of a pair of elongated flexible cables, each of the cables having a first end and a second end, each first end secured to the upper portion of the rotating portion of the front portion, each second end secured to the pair of securement portions of the rudder.

* * * * *